US010159314B2

(12) United States Patent
Kirth et al.

(10) Patent No.: US 10,159,314 B2
(45) Date of Patent: Dec. 25, 2018

(54) TEXTILE PRODUCT

(75) Inventors: Rudolf Kirth, Vöcklabruck (AT); Susanna Schiemer, Linz (AT); Christoph Ebel, Bad Wimsbach-Neydharting (AT)

(73) Assignee: TEUFELBERGER GESELLSCHAFT M.B.H., Wels (AT)

( * ) Notice: Subject to any disclaimer, the term of this patent is extended or adjusted under 35 U.S.C. 154(b) by 1242 days.

(21) Appl. No.: 12/450,152

(22) PCT Filed: Mar. 28, 2008

(86) PCT No.: PCT/AT2008/000116

§ 371 (c)(1), (2), (4) Date: Sep. 14, 2009

(87) PCT Pub. No.: WO2008/119093

PCT Pub. Date: Oct. 9, 2008

(65) Prior Publication Data

US 2010/0035000 A1 Feb. 11, 2010

(30) Foreign Application Priority Data

Mar. 30, 2007 (AT) ..... GM 209/2007 U

(51) Int. Cl.
*D06Q 1/00* (2006.01)
*A44C 17/02* (2006.01)
(Continued)

(52) U.S. Cl.
CPC ..... *A44C 17/02* (2013.01); *D03D 13/00* (2013.01); *D03D 15/0077* (2013.01);
(Continued)

(58) Field of Classification Search
CPC ..... A44C 17/005; A44C 17/04; A44C 17/02; Y10T 29/23; Y10T 29/49838; Y10T 29/49865; Y10T 428/249921; Y10T 428/249922; Y10T 428/24479; Y10T 428/23; Y10T 428/1334; D07B 1/145; D07B 2301/555; D04B 1/00; D04D 9/04; D04C 1/06; D10B 2505/02; D10B 2403/023; D10B 2403/0243
(Continued)

(56) References Cited

U.S. PATENT DOCUMENTS 5,070,586 A 12/1991 Pöll
5,341,758 A 8/1994 Strickland
(Continued)

FOREIGN PATENT DOCUMENTS

AT 148 187 12/1936
AT 005 282 5/2002
(Continued)

OTHER PUBLICATIONS

International Search Report.

*Primary Examiner* — Elizabeth M Cole
(74) *Attorney, Agent, or Firm* — Collard & Roe, P.C.

(57) ABSTRACT

A textile product (1) comprising individual elements (4) interconnected by a textile technique, characterized in that the interconnected individual elements (4) hold at least one decorative or functional element (2, 2', 2", 12, 12', 22) between each other, e.g. by braiding in or braiding around.

26 Claims, 7 Drawing Sheets

(51) Int. Cl.

| | |
|---|---|
| ***D03D 15/00*** | (2006.01) |
| ***D04C 1/06*** | (2006.01) |
| ***D04D 9/04*** | (2006.01) |
| ***D04B 1/00*** | (2006.01) |
| ***D07B 1/14*** | (2006.01) |
| ***D03D 13/00*** | (2006.01) |
| ***D03D 15/02*** | (2006.01) |
| ***D03D 23/00*** | (2006.01) |
| ***D03D 41/00*** | (2006.01) |
| ***D03D 47/18*** | (2006.01) |
| ***D03D 47/23*** | (2006.01) |
| ***D03D 49/06*** | (2006.01) |

(52) U.S. Cl.
CPC ..... *D03D 15/0088* (2013.01); *D03D 15/02* (2013.01); *D03D 23/00* (2013.01); *D03D 41/008* (2013.01); *D03D 47/18* (2013.01); *D03D 47/23* (2013.01); *D03D 49/06* (2013.01); *D04B 1/00* (2013.01); *D04C 1/06* (2013.01); *D04D 9/04* (2013.01); *D07B 1/145* (2013.01); *D07B 2301/555* (2013.01); *D10B 2403/023* (2013.01); *D10B 2403/0243* (2013.01); *D10B 2505/02* (2013.01); *Y10T 428/1334* (2015.01); *Y10T 428/23* (2015.01); *Y10T 428/24479* (2015.01); *Y10T 428/249921* (2015.04); *Y10T 428/249922* (2015.04)

(58) Field of Classification Search
USPC ..... 428/35.2; 442/204
See application file for complete search history.

(56) References Cited

U.S. PATENT DOCUMENTS

| | | | | |
|---|---|---|---|---|
| 5,658,150 | A * | 8/1997 | Moreau | 434/156 |
| 2005/0178154 | A1 * | 8/2005 | Horan | A44C 5/2095 63/3.1 |

FOREIGN PATENT DOCUMENTS

| | | | |
|---|---|---|---|
| DE | 19 05 270 | | 11/1964 |
| DE | 19 39 536 | | 5/1966 |
| DE | 41 04 336 | | 10/1992 |
| DE | 29908787 | U1 * | 7/1999 |
| EP | 0 423 569 | | 4/1991 |
| GB | 1 015 389 | | 12/1965 |
| GB | 1 123 797 | | 8/1968 |
| WO | WO 2005/069960 | | 8/2005 |

* cited by examiner

TEXTILE PRODUCT

CROSS REFERENCE TO RELATED APPLICATIONS

This application is the National Stage of PCT/AT2008/000116 filed on Mar. 28, 2008, which claims priority under 35 U.S.C. § 119 of Austrian Application No. GM 209/2007 filed on Mar. 30, 2007. The international application under PCT article 21 (2) was not published in English.

The invention relates to a textile product, such as a braided structure, preferably a linear braided structure, e.g. a braided cord or string, comprising individual elements, such as, e.g., twines, yarns, monofilaments, braided or twined strings, strips or the like, which are interconnected by braiding, knitting, weaving, interlacing of yarns or the like.

Moreover, the invention relates to a manufactured item made of such products in the form of cords or the like which have been processed to a woven fabric, a knitted fabric, a fabric of interlaced yarns, a knotted element or a crocheted element, in particular for decorative purposes.

Textile braided structures, having, e.g., the form of braided cords or braided strings, such as braided laces, are used for the most varying purposes, in particular for packaging purposes or for tying up packages, in the sailing and mountaineering sports, for fall protection means for persons, as strings for shutters, as cords for fishing nets and the like.

From DE 19 39 536 U it is known to attach setting means for gem-stones in a planar textile fabric in that the holding means have rear pin-shaped projections that are inserted through openings in the planar fabric and in that, on their rear sides, the projections are deformed in rivet-head-like manner. This attachment of decorative stones on planar textile products by way of thermally deformed setting means thus is cumbersome and complex.

Furthermore, DE 41 04 336 C describes a compound of gemstones in which a grid of longitudinal threads and transverse threads is used, these threads being bonded to each other at their points of intersection, and at least one group of these threads engaging in grooves which are provided in gemstones arranged in said grid. In this instance, the threads consist of a shrunk synthetic material. This compound of gemstones is intended as a prefabricated product and subsequently is fastened to an object to be decorated, e.g. the wristband of a watch.

From DE 19 05 270 U gemstones made of glass are known which, in particular, are to be usable as buttons and, accordingly, are provided with central holes so as to enable sewing of these gemstones to a substrate.

Finally, from AT 5282 U a woven material ("textile crystal material") is known, in which the stones are woven into the material in the form of a mounted band, both in the warp direction and also in the weft direction. It is, however, not said how the crystals are attached to the warp and weft threads, and when weaving with such "crystal threads" there is the risk of the crystals becoming detached from the threads.

The invention now has as its object to develop a textile product, in particular a braided structure, to be used for new purposes, that is decorative purposes, or having special functions, and comprising a new connecting technique.

To achieve this object, the invention provides a textile product as defined in claim 1. Advantageous embodiments and further developments are indicated in the dependent claims.

According to the present technique, the decorative or functional elements, respectively, such as stones, glass stones, e.g., or also minerals, artificial stones, pieces of wood, artificial flowers etc., or weights, magnets, luminescent elements, etc., in particular in compact, more or less round or oval or polygonal shape, just as of elongate shape (of stick or dumb-bell or star shape), are directly integrated in the textile material in that the individual elements mechanically fix the decorative or functional elements, e.g. by braiding them in or braiding around them, the decorative or functional elements being inserted, e.g., at points of intersection or in mesh areas of the individual elements. The decorative or functional elements can be fixed between individual elements in the manner of being tied around or pinched, it also being conceivable to fan out the individual elements, thereby enclosing the decorative or functional element(s) in fan-like or basket type manner. By the fact that the individual elements are tensioned in the textile product during braiding, weaving, knitting etc., the y firmly lie against the outer side of the respective decorative or functional element, thus causing its fixation by non-positive or positive fit. Moreover, for achieving in a Particularly firm hold of the decorative or functional elements between the individual elements, a depression, notch, recess or a centrally-located thinned portion or zone may be provided on the decorative or functional element for receiving at least one individual element. This depression etc. may extend over a part of the periphery of the decorative or functional element like a flute, yet also a continuous circumferential groove may be provided which additionally facilitates binding or braiding the decorative or functional elements into the textile product, since in that case no attention needs to be paid to orienting the decorative or functional elements with their flutes to the individual elements when inserting the decorative or functional elements. For attaching the decorative or functional elements it is, in any event, also advantageous if the decorative or functional elements are axially symmetrical, or rotationally symmetrical, respectively. As said thinned zone, the decorative or functional elements may, however, also have a central taper, whereby, e.g., dumb-bell or stick-shaped decorative or functional elements will be obtained.

The braided structure may be provided in the form of a thin rope, a cord or a string, yet a braided structure, a knitted structure etc. may be produced around an e.g. cylindrical or conical core, the decorative or functional elements being inserted, in particular braided in; the core may subsequently be peeled out, so that a tubular product will be obtained. This tubular textile product may be used as such, it may, however, also be cut open, so that a planar, in particular strip-shaped braided structure or knitting or woven fabric etc. will be obtained.

Depending on the decorative purpose or function desired, the most varying fibrous materials may be used as the individual elements, such as multifilaments, just as well as monofilaments and also staple fibres. The fibrous material may consist of PES, PA, PP, PE etc., yet also of fibre glass etc. Furthermore, fibrous materials, in particular monofilaments, made of a phosphorescent or fluorescent material are already known, and such "luminescent" fibrous materials may also be advantageously employed for the present decorative or functional element-containing braided structure. The fibrous materials may also have different colours and/or have a metal gloss, and they may be mixed within individual elements or may also be used for different individual elements.

Furthermore, here, it is advantageous, too, in particular if a planar textile structure is provided, if the textile element is fixed in its shape, for which purpose the individual elements may be impregnated with a thermoplastic and/or a thermally curing material or binder or be produced of such a material so as to bring the product into the desired shape by a final curing, optionally after a previous softening of the same. For this purpose, e.g., the individual elements may consist of thermobonding fibres, of binder-impregnated fibres and/or of thermoplastic fibres.

Decorative or functional elements of the most varying shapes and colours can be "pinched" in the textile product, depending on the desired purpose, such as, in particular, glass stones of various colours, and this within one and the same textile product. The arrangement of these decorative or functional elements within the textile product, in particular braided structure, may, moreover, be effected within at least substantially constant spacing or, however, also with variable spacing. In the case of elongate decorative or functional elements in which one (main) axis can be defined, it is furthermore conceivable to attach these decorative or functional elements such within the textile product that they all are present with their axes in parallel or such that they are fixed with their axes rotated relative to each other.

The textile product, e.g. the braided structure, may be made in the most varying known manners, with different numbers of individual elements and various lengths of lay or mesh sizes, for which per se conventional production machines can be used. The decorative or functional elements may then, e.g., be mounted at the desired sites in the textile product by stopping the machine and manually inserting the decorative or functional element, respectively. Yet, of course also an automatic insertion of the decorative or functional elements is conceivable, wherein, e.g., the braiding, weaving or knitting machine may be automatically slowed down for this insertion phase.

The textile product obtained, in particular in the form of a braided cord or a braided rope may also be further processed by weaving, interlacing, knotting, knitting, crocheting or the like so as to obtain a curtain-like (décor) structure, for instance.

The present textile product, in particular braided structure, may, e.g., be used for decorating showrooms, salesrooms, shop windows and so on, or as a decorative cape, as a piece of clothing. The incorporated decorative or functional elements may also (optionally in addition) have the function of conferring weight to the said textile products so as to obtain tautly downwardly hanging curtain-like structures or strings in the case of showroom decorations or in order to cause cords, ropes etc. loaded in this manner to sink down in water. One function may also consist in that the inserted decorative or functional elements are designed as luminescent elements, wherein these luminescent elements may, e.g., be connected to an electric voltage in that an electrically conductive wire is incorporated in the textile product together with the individual elements. A further option also consists in providing magnets as decorative or functional elements. This is particularly suitable with linear textile products, i.e. with products having the form of cords, strings, ropes or the like, since with the help of the magnets and in cooperation with electromagnetic measuring devices or detecting devices, respectively, the spacing between such magnetic decorative or functional elements can be detected; in doing so, also unintentional changes in length can be detected if, for instance, strings or ropes are concerned.

In order to be more or less fixed by positive locking by the individual elements, the decorative or functional elements may also be provided with recesses delimited by thorn-like, spike-like, pin-like or similar projections. It is, for instance, conceivable to provide spheres having thorn-like projections as said decorative or functional elements, the individual elements being held between said thorn-like projections, whereby a connection by positive locking is obtained with the spherical decorative or functional elements. A similar connection by positive locking is obtained if the decorative or functional elements are star-shaped. In this case, it is furthermore possible to provide at least one—optionally longer—projection with a bore so that in case of a rope-shaped textile product provided with these elements, the former can be connected to a shaft.

The incorporated, positively locked decorative or functional elements may additionally serve for improving the adhesion of a coating subsequently applied to the textile product, e.g. a coating sprayed around a rope.

The invention will now be described in more detail by way of preferred exemplary embodiments illustrated in the drawings without, however, being restricted to these embodiments. Therein:

Figure 7:
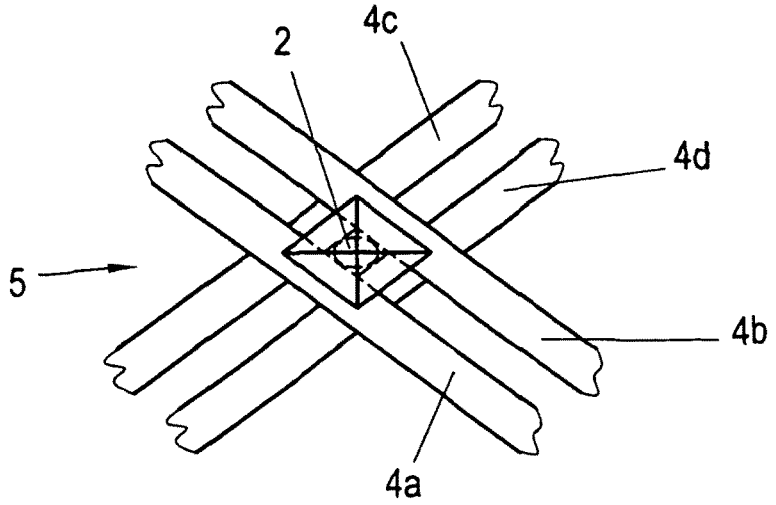
Figure 8:
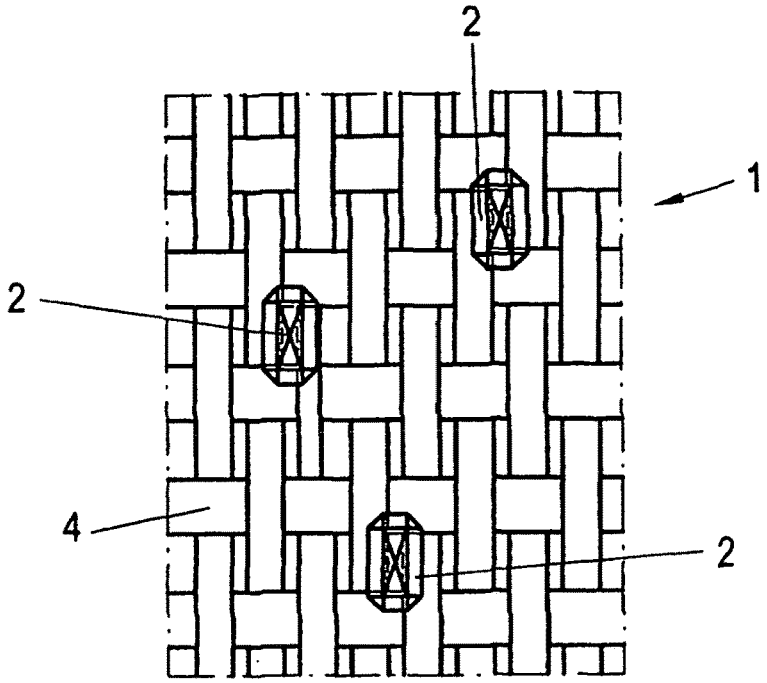
Figure 9:
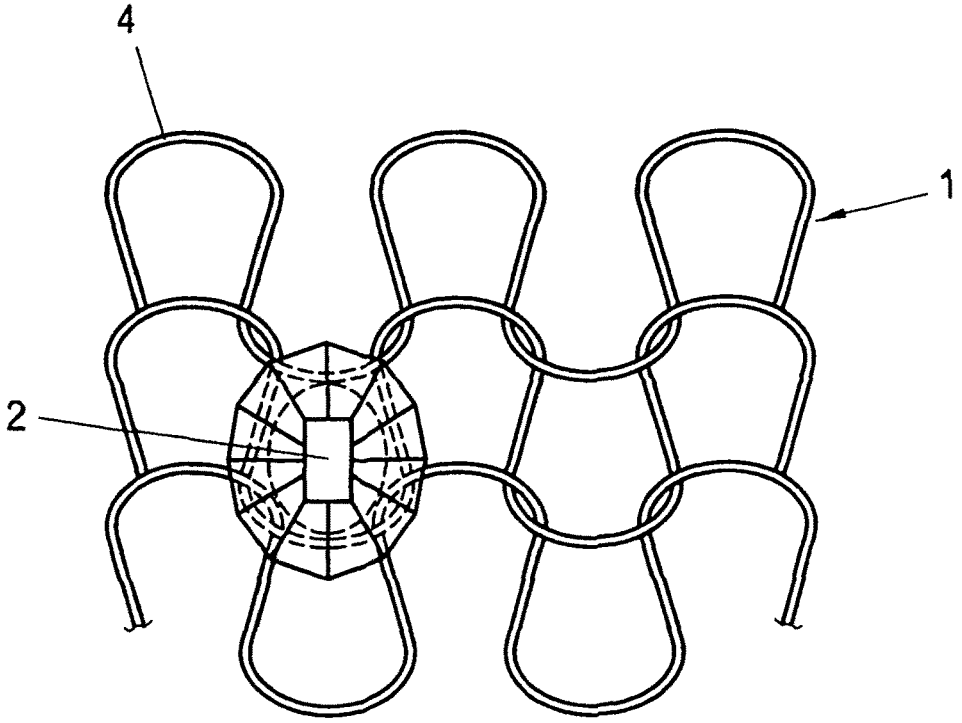
Figure 10A:
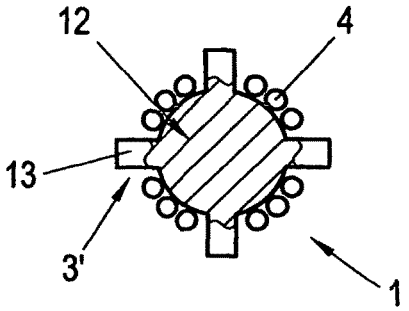
Figure 10B:
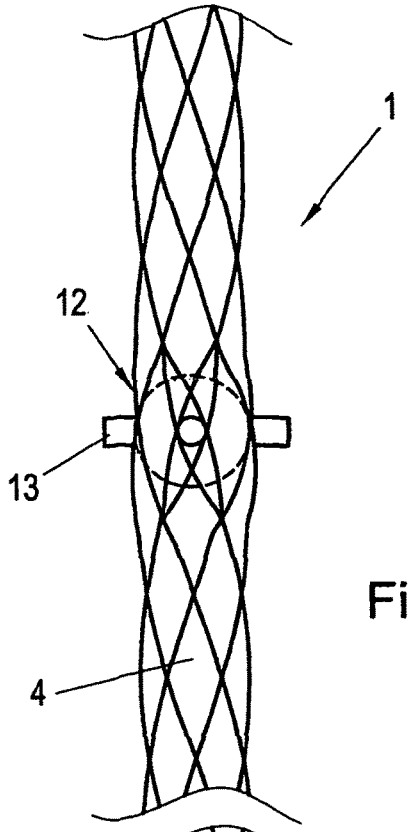
Figure 11A:
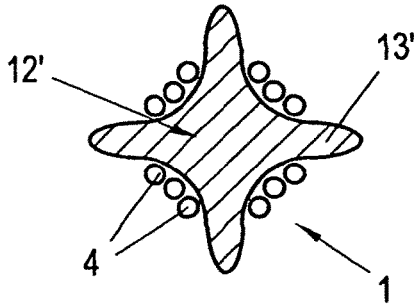
Figure 11B:
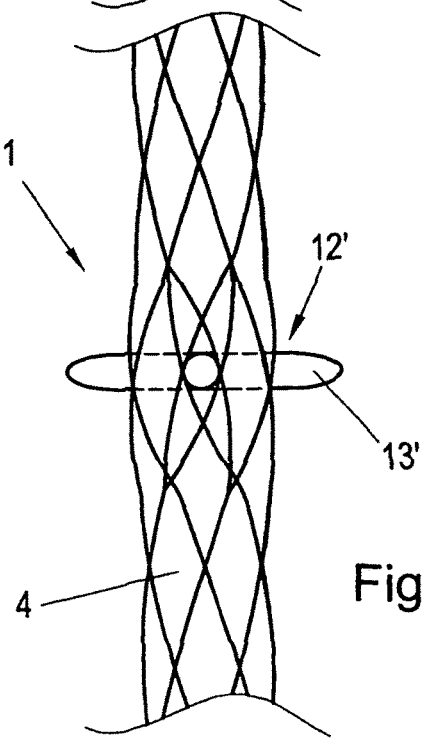
Figure 12A:
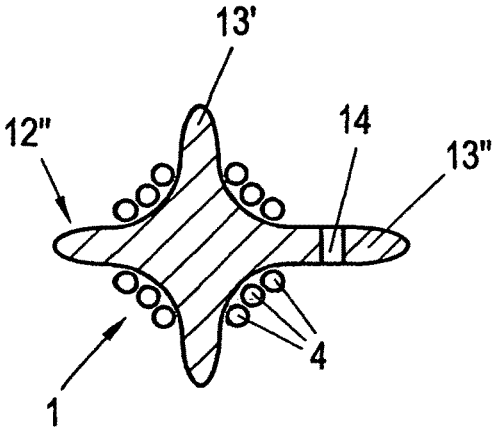
Figure 12B:
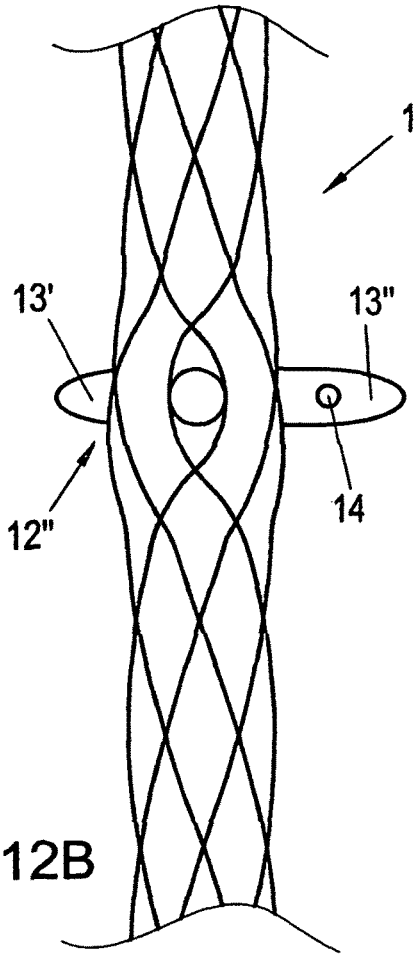
Figure 13:
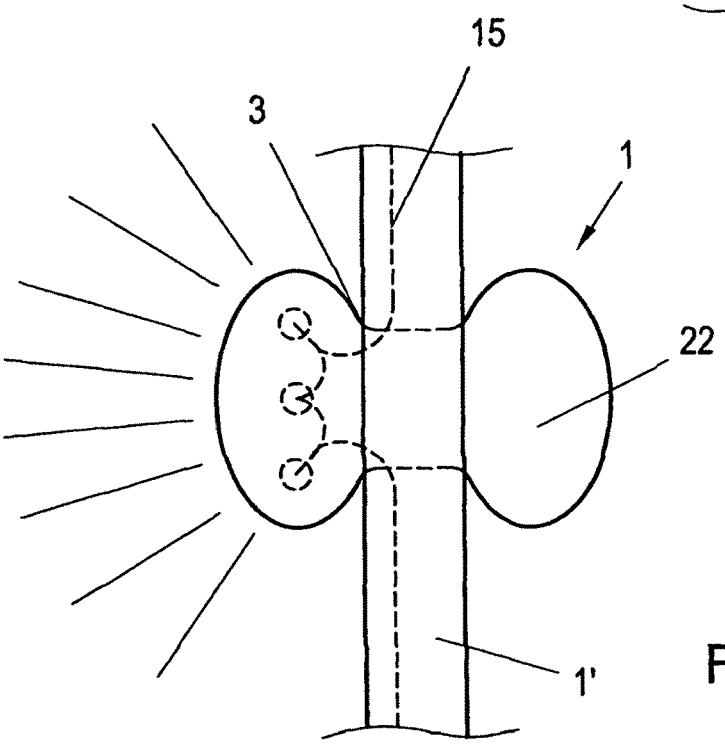

FIG. 7 schematically shows an intersection in a braided structure, wherein two individual elements intersect with two other individual elements;

FIGS. 8 and 9 show two further textile products, i.e. in the form of a woven fabric (FIG. 8) or of a knitting (FIG. 9), with decorative or functional elements incorporated therein;

FIGS. 10A and 10B show a cord-shaped braided structure with a spherical decorative or functional element serving as a weight in a sectional representation and a partial view, respectively;

FIGS. 11A and 11B show a decorative or functional element in a star-shaped embodiment in comparative illustrations;

FIGS. 12A and 12B show a star-shaped decorative or functional element as a further development of the embodiment according to FIGS. 11A and 11B with an elongated projection in which a bore is provided for attachment to a shaft; and FIG. 13 schematically shows a braided cord structure with a luminescent element provided as decorative or functional element braided thereinto.

Figure 1:
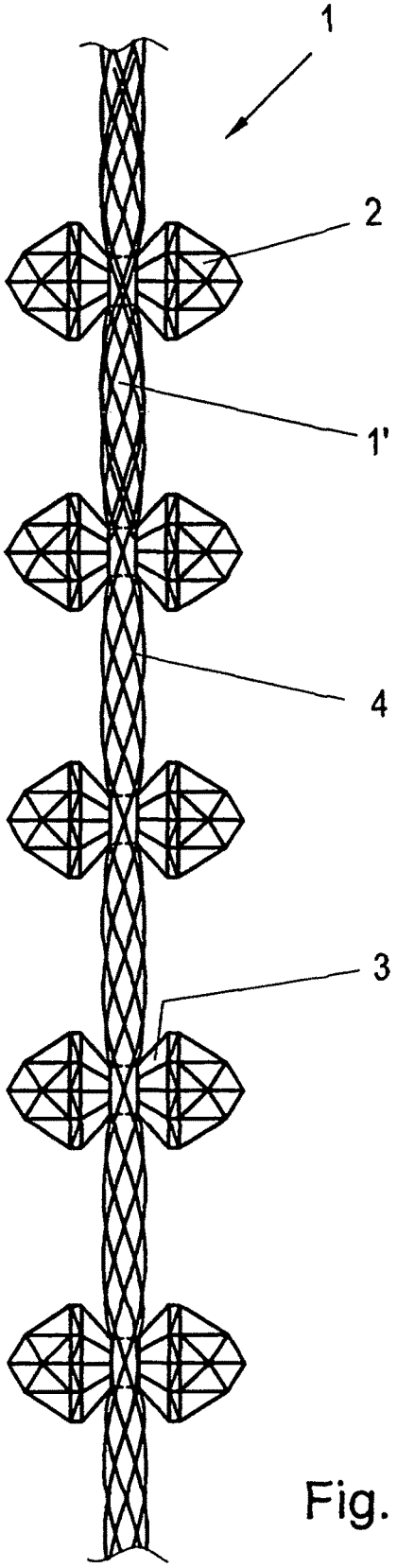
FIGS. 1 and 2 show sections of braided structures in the form of cords or strings comprising similar, e.g. dumb-bell-shaped glass stones which, however, have been braided in at various distances from each other as well as once axis-parallel (FIG. 1) and once with axes rotated relative to each other (FIG. 2)

In FIG. 1, a braided structure 1' in the form of a braided cord, string or rope is shown as textile product 1, wherein decorative elements 2, e.g. in the form of elongate glass stones having a central, continuous thinned portion, taper or depression 3 are braided in at comparatively short distances from each other at intersections between the individual elements 4 of the braided structure 1'. Here, the individual elements 4 nest in the circumferentially continuously extending depression 3, and due to the tension applied during braiding, the individual elements 3 safely and tightly retain the decorative elements 2 within the braided structure 1'.

According to FIG. 1, substantially alike decorative elements 2 are braided into the braided structure 1, and also the distances of the decorative elements 2 from each other are equal or regular, respectively. Moreover, the decorative glass stone elements 2 which, due to their dumb-bell shape are elongate and stick-shaped, have main axes which, in the embodiment according to FIG. 1 in the braided-in state of the decorative elements 2, when the linear braided structure 1 is laid out, extend in parallel to each other.

Figure 2:
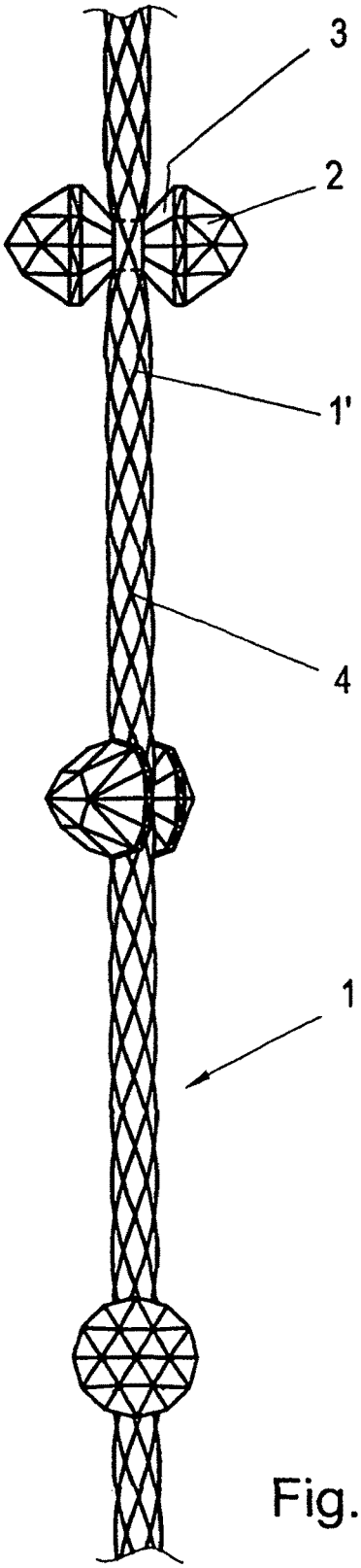

In FIG. 2, a similar textile product 1, i.e. a braided structure 1' in the form of a cord or string is shown, in which, again, decorative glass stone elements 2 are fixed between individual elements 4 of the braided structure 1' by braiding them thereinto. The decorative glass stone elements 2 are designed similar to those according to FIG. 1, yet now they are in the relaxed state of the braided structure 1', e.g. when the latter is arranged hanging, with their main axes rotated relative to each other. Moreover, compared to FIG. 1, the distances between the decorative elements 2 are larger; the distances may also be variable.

Figure 3:
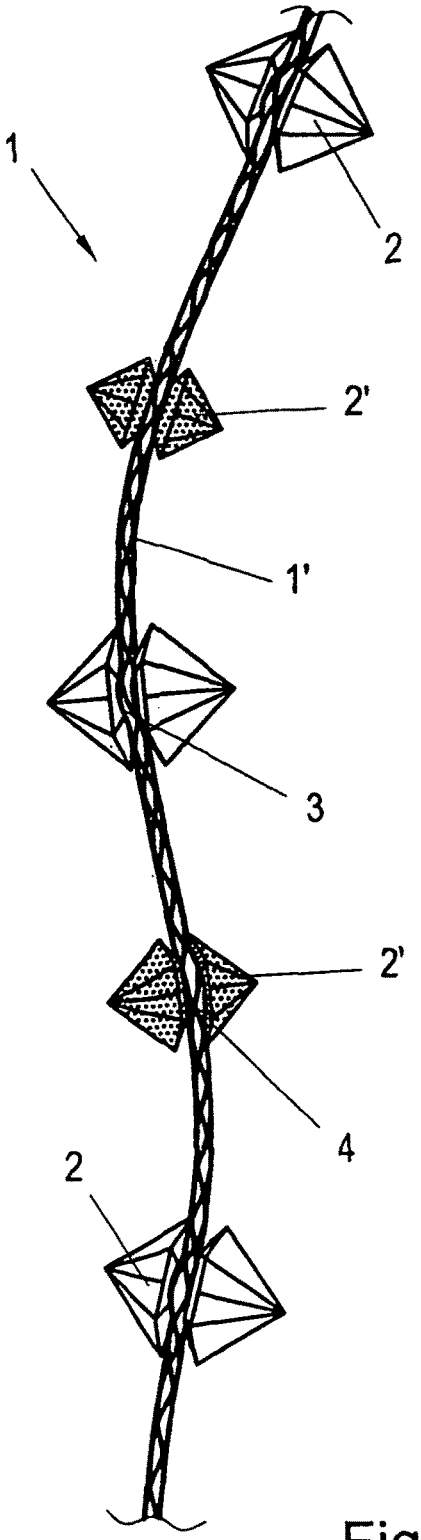
FIG. 3 shows a different, string-shaped braided structure, this time with differing decorative glass stone elements.

In the braided structure 1' which is illustrated in FIG. 3 and which, again, is string, rope or cord-shaped, larger and smaller decorative glass stone elements 2, 2' are alternately braided in, this being in a manner as basically shown in FIGS. 1 and 2. The decorative elements 2, 2' are designed as double cones or double pyramids having a central, thinner connecting region as thinned portion or as continuously extending peripheral notch or groove 3, so that the individual elements 4 can snugly nest in this notch, groove or depression 4, thereby securely retaining the decorative elements 2, 2'. The decorative elements 2, 2' do not only differ in size, but also in colour, as has been indicated by dotting the decorative elements 2'.

Figure 4:
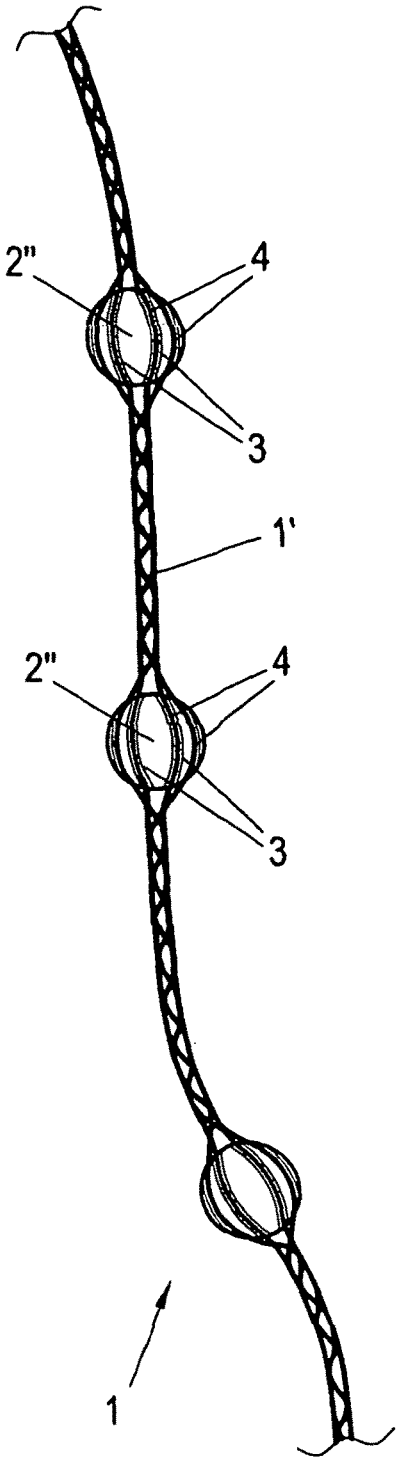
FIG. 4 shows an embodiment of a braided cord with oval decorative stones which are braided in or held between the basket-like, fanned-out individual elements, enclosed by the latter on all sides.

In FIG. 4, a further cord, string or rope-shaped braided structure 1' is shown as the textile product 1, in which the individual elements 4 are fanned out at the site of the decorative glass stone elements 2" so that they enclose the substantially egg-shaped or spherical decorative glass stone elements 2" in basket-like or fan-like manner. Also in this way, the decorative elements 2" can be tightly retained in the braided structure 1'. Here, the individual elements 4 may also be laid into generally longitudinally extending notches 3 of the decorative elements 2" so as to increase the hold thereof.

The previously described decorative elements 2, 2', 2" may also have certain functions, such as the function of a weight, for loading the textile products 1, in which they are arranged, so as to cause these textile products 1 to hang down tautly, e.g. in the case of showroom decorations. These weight-elements may nevertheless also have a decorative function. Instead of decorative glass stone elements or the like, it is also conceivable to retain decorative or functional elements 2, 2', 2" or a magnetic material in the above-described manner in the textile products 1 or braided structures 1', respectively, by positive locking. Here it may suffice to mount such magnetic elements at relatively large distances in cords, strings or ropes 1' in order to detect the distances between these magnetic elements 2, 2', 2" by means of electromagnetic measuring or detecting devices, respectively, and to thereby detect any total lengths, or also changes in length.

The above-described decorative or functional elements 2, 2', 2" may also be shaped such that, in case a coating is applied to or sprayed around a—for instance linear—braided structure 1', they will cause an improved adhesion of this sprayed-around material or coating on said product 1, or 1', respectively, if the adhesion on the individual (rope) elements 4 otherwise maybe were insufficient.

The individual elements 4 may consist of multifilaments, monofilaments, staple fibres, e.g. of polyamide (PA), polypropylene (PP), polyethylene (PE), polyester, in particular polyethylene terephthalate (PES), of fibre mixtures, or also of fibre glass, or of phosphorescent fibre material. It is also possible to use thermobonding fibres, fibres impregnated with a binder or thermoplastic fibres so as to enable a subsequent curing or shaping of the respective braided structure.

Instead of being rope-shaped, the braided structure 1' may also be tubular, e.g., as is known per se, by braiding around a cylindrical or conical core (not shown), the decorative parts 2 being braided in at the desired points of intersection. Subsequently, the core is peeled out, so that the tubular braided structure is obtained.

Such a tubular braided structure 1' may subsequently also be cut open, whereby a planar structure or strip is obtained.

Figure 5:
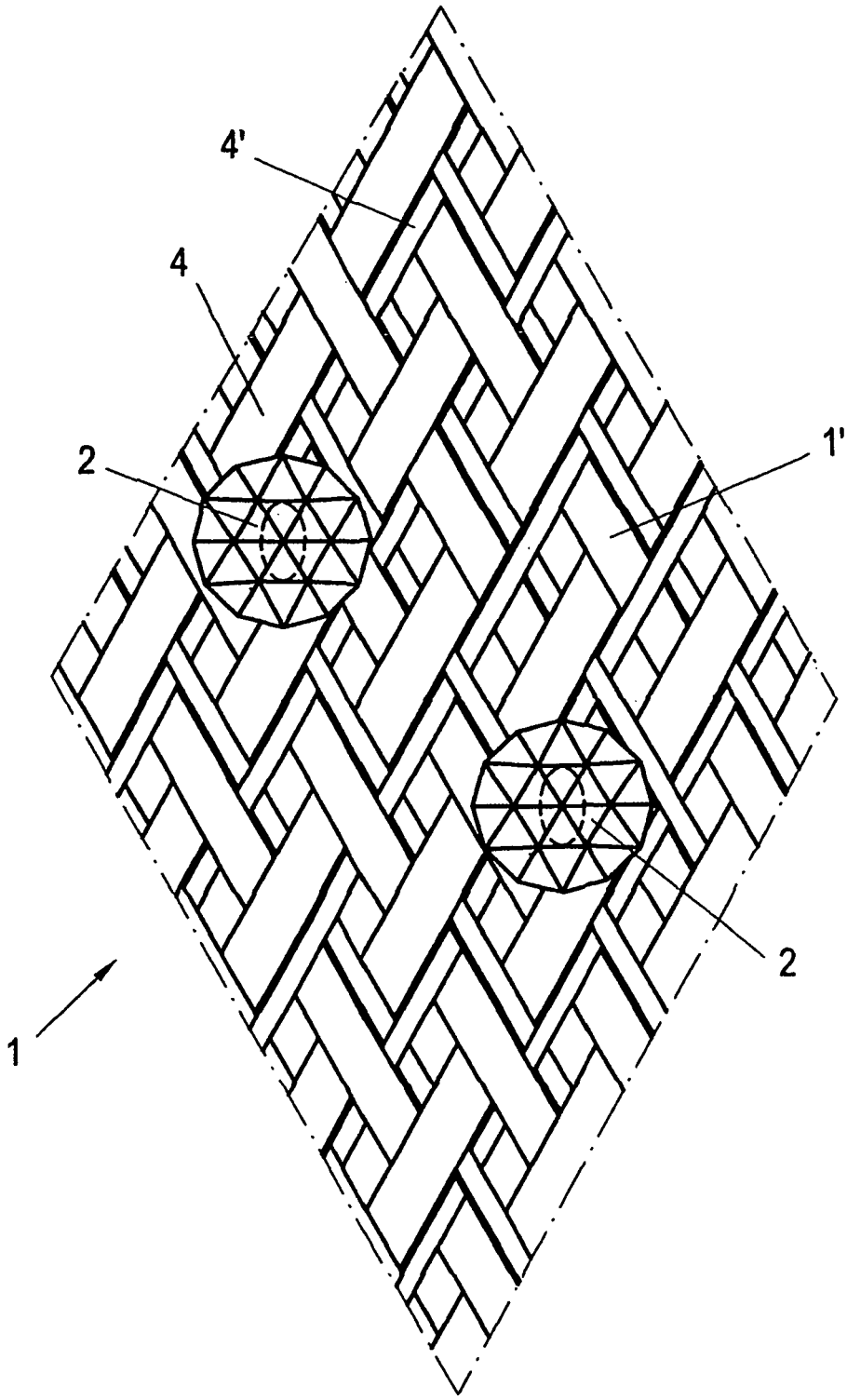
FIGS. 5 and 6 show parts of two planar braided structures.
Figure 6:
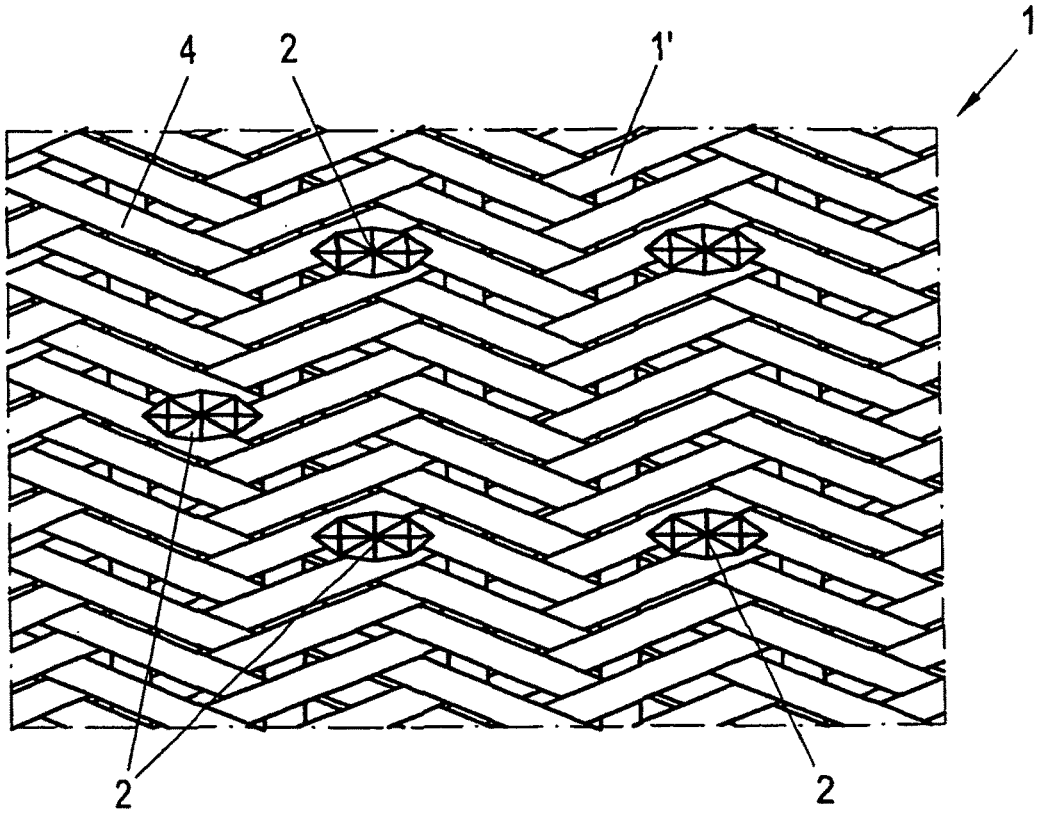

In FIG. 5, such a planar textile product 1 in the form of a braided biaxial structure, and in FIG. 6 in the form of a braided triaxial structure 1' is shown by way of example.

Furthermore, FIG. 7 quite generally shows the insertion of a decorative or functional element 2 at a point of intersection 5 of, e.g., two individual elements 4*a*, 4*b*, with two other individual elements 4*c*, 4*d*. The entwined individual elements 4 may as such extend under arbitrary angles and may also intersect in arbitrary numbers, wherein, e.g. instead of an intersection between two/two individual elements 4, as shown in FIG. 7, also intersections between two/one single element or between one/one single element etc. are conceivable.

From FIG. 5 it can furthermore be seen that the individual elements may also differ from each other, wherein in FIG. 5 differently wide strip-shaped individual elements 4 and 4' are shown.

In FIGS. 8 and 9, yet other textile products 1 are shown in which, between the individual elements 4, likewise decorative or functional elements 2 are clampingly retained (by positive locking), e.g. in the region of thinned portions or the like as has been shown in FIGS. 1-4 at 3. In detail, FIG. 8 shows a woven fabric as the textile product 1, whereas FIG. 9 shows a knitting as the textile product 1.

In FIGS. 10A and 10B, a linear textile product 1, e.g. in the form of a braided string or cord, or of a braided rope, respectively, is shown in a schematic cross section and in a partial view, respectively, wherein a decorative or functional element 12 in the form of a sphere is shown which is provided with thorn-type projections 13, at least along its equator. These thorn-type projections 13 delimit recesses 3' between them, in which recesses the individual elements 4 of the textile product 1 are received and retained. In this manner, more or less a connection by positive locking is ensured between the individual elements 4 and these spherical decorative or functional elements 12, positive locking in the longitudinal direction also being obtained by the fact that the individual elements 4 are arcuately braided around the thorn-type projections 13.

Similar arguments hold also for the star-shaped decorative or functional elements 12', as is shown by way of example in FIGS. 11A and 11B, in views similar to those of FIGS. 10A and 10B. In this embodiment, the star-shaped decorative or functional elements 12' have spike-shaped projections 13' between which again the individual elements 4, e.g. of a braided cord, string, or of a braided rope are inserted as the textile product 1 during said braiding therearound.

In FIGS. 12A and 12B a modification of the star-shaped decorative or functional element is shown. This decorative or functional element 12" according to FIGS. 12A, 12B has an elongated projection 13" which is provided with a bore 14 that may serve for attachment of the braided rope etc. to a shaft.

Finally, in FIG. 13 an embodiment is shown in which luminescent elements 22 are fixed as decorative or functional elements in the textile product 1, e.g. in the form of a braided string 1' or the like. In order to supply LEDs, e.g., which are provided in these luminescent elements 22, with an electric current, an electrically conductive wire 15 may be incorporated in the textile product 1, which wire may, e.g., emerge from the ends of the textile product 1 and be connected to a current source not further illustrated. Alternatively, the luminescent elements 22 may also be provided with separate battery elements (not shown).

The invention claimed is:

1. A textile product comprising individual elements which are interconnected by a textile technique consisting of braiding to form a cord-shaped structure, wherein the interconnected individual elements retain at least one length measuring element between them, by directly integrating the at least one length measuring element into the textile product such that the individual elements within the braided structure surround the length measuring element, said at least one length measuring element comprising a body defining an outer surface, wherein the individual elements are tensioned in the textile product so that said individual elements firmly lie against the outer surface of the body, wherein the at least one length measuring element has at least one depression, recess or thinned portion for receiving the individual elements, wherein the at least one length measuring element has areas outside the depression, recess or thinned portion that are exposed between the individual elements, and wherein the at least one length measuring element is a detectable magnet.

2. A textile product according to claim 1, wherein the at least one magnet is held between more than two interconnected individual elements.

3. A textile product according to claim 1, wherein the individual elements enclose the at least one magnet in basket-like or fan-like manner by fanning-out the individual elements compared to the otherwise straight structure of the textile product.

4. A textile product according to claim 1, wherein the depression, recess or thinned portion comprises at least one continuous peripheral notch.

5. A textile product according to claim 1, wherein the at least one magnet has the shape of a sphere with projections, said projections having a diameter smaller than a diameter of the sphere, said projections delimiting receiving recesses for the individual elements.

6. A textile product according to claim 1, wherein the at least one magnet is star-shaped.

7. A textile product according to claim 1, wherein the at least one magnet has a projection with a bore.

8. A textile product according to claim 1, wherein the at least one magnet constitutes a weight element, that causes the textile product to hang down tautly.

9. A textile product according to claim 1, further comprising at least one functional element formed by a luminescent element.

10. A textile product according to claim 9, wherein at least one electrically conductive wire is incorporated in the textile product, which wire is connected to the luminescent element.

11. A textile product according to claim 1, wherein the individual elements are selected from the group consisting of twines, yarns, monofilaments, braided strings, and strips.

12. A textile product according to claim 1, wherein at least one of said individual elements is formed of a monofilament.

13. A textile product according to claim 1, wherein at least one of said individual elements is formed of a multifilament.

14. A textile product according to claim 1, wherein at least one of said individual elements is formed of staple fibres.

15. A textile product according to claim 1, wherein at least one of said individual elements is formed of fibre glass material.

16. A textile product according to claim 1, wherein at least one of said individual elements is selected from the group consisting of polyamide, polypropylene, polyethylene, polyester and polyethylene terephthalate.

17. A textile product according to claim 1, wherein at least one of said individual elements is made of a phosphorescent or of a fluorescent fibrous material.

18. A textile product according to claim 1, a shape of the individual elements is fixed by one of a binder, resin, or thermoplastic or by thermal fixation of thermoplastic individual elements.

19. A textile product according to claim 17, wherein at least one of said individual elements is impregnated with a binder.

20. A textile product according to claim 17, wherein at least one of said individual elements comprises a thermobonding fibre.

21. A woven fabric comprising at least one cord-shaped braided structure according to claim 1.

22. A knitting comprising at least one cord-shaped braided structure according to claim 1.

23. A knotted product comprising at least one cord-shaped braided structure according to claim 1.

24. A crocheted product comprising at least one cord-shaped braided structure according to claim 1.

25. A textile product according to claim 1, wherein the individual elements constitute a strip-shaped product.

26. A textile product comprising individual elements which are interconnected by a textile technique, to form a braided linear structure, wherein the interconnected individual elements retain at least one magnet between them, by directly integrating the at least one magnet into the textile product such that the magnet is surrounded by the braided linear structure, said at least one magnet comprising a body defining an outer surface, wherein the individual elements are tensioned in the textile product so that said individual elements firmly lie against the outer surface of the body, wherein the at least one magnet has a centrally located thinned portion for receiving the individual elements, wherein the at least one magnet is dumb-bell-shaped or stick-shaped, and wherein the at least one magnet is exposed between the individual elements.

* * * * *